US006050553A

United States Patent [19]

Cable et al.

[11] Patent Number: 6,050,553

[45] Date of Patent: Apr. 18, 2000

[54] DEVICE FOR CONNECTING SPRINGS TO FORM A SUPPORT SURFACE THEREWITH

[75] Inventors: David Andrews Cable, Valdese; Melvin Ervin Butler, Lawndale, both of N.C.

[73] Assignee: Hickory Springs Manufacturing Co., Hickory, N.C.

[21] Appl. No.: 09/123,278

[22] Filed: Jul. 28, 1998

[51] Int. Cl.[7] ..... F16F 3/00

[52] U.S. Cl. ..... 267/91; 5/259.1; 5/267; 5/270

[58] Field of Search ..... 267/80, 89, 91–101, 267/102, 103, 104, 105, 106, 110, 111, 112; 5/259.1, 270, 617, 258, 267, 248, 246, 256, 266, 264.1, 269

[56] References Cited

U.S. PATENT DOCUMENTS

| | | |
|---|---|---|
| 160,274 | 3/1875 | McMains . |
| 196,469 | 10/1877 | Merrick . |
| 245,553 | 8/1881 | Peck . |
| 269,641 | 12/1882 | Cruzan . |
| 392,009 | 10/1888 | Cleaveland . |
| 434,794 | 8/1890 | Leggett . |
| 453,850 | 6/1891 | Warner . |
| 1,131,346 | 3/1915 | Durst . |
| 1,273,428 | 7/1918 | Vincent . |
| 1,322,263 | 11/1919 | Oldfield . |
| 1,355,133 | 10/1920 | Edwards . |
| 1,372,702 | 3/1921 | Kreuzkamp . |
| 1,433,229 | 10/1922 | Reidenbach . |
| 1,456,738 | 5/1923 | Lathrop . |
| 1,625,817 | 4/1927 | Marquardt . |
| 1,746,942 | 2/1930 | Hise . |
| 1,897,396 | 2/1933 | Oldham . |
| 1,915,908 | 6/1933 | Thomas . |
| 1,923,739 | 8/1933 | Moske . |
| 1,925,066 | 8/1933 | Barnard . |
| 1,964,296 | 6/1934 | Moeckel . |
| 1,998,898 | 4/1935 | Konkel . |
| 2,055,754 | 9/1936 | Schwartzman . |
| 2,070,963 | 2/1937 | Schwartzman . |
| 2,164,962 | 7/1939 | Tampkin . |
| 2,542,354 | 2/1951 | Platt . |
| 2,689,962 | 9/1954 | Hutcheson . |
| 3,624,846 | 12/1971 | Rub . |
| 3,715,766 | 2/1973 | Slominski ..... 5/276 |
| 3,881,713 | 5/1975 | Joyce ..... 267/95 |
| 4,055,337 | 10/1977 | Laiche et al. . |
| 5,485,639 | 1/1996 | Cavazos . |

*Primary Examiner*—Douglas C. Butler

*Attorney, Agent, or Firm*—Kennedy Covington Lobdell & Hickman

[57] ABSTRACT

A device for connecting springs together to define a support surface includes four arms each which extend in an outward radial direction from a center of the connecting device, the length of each arm defined by two sides extending in spaced relation to one another. Each arm includes a stiffening portion extending in a widthwise direction between the sides of the arm and extending from an end thereof towards the center of the connecting device only partially along the length of the arm. The straight sides of each arm have identical height dimensions and the stiffening portion has a lesser height than the height of the sides. The sides and the stiffening porting of each arm together define a planar surface of the arm and a finger portion extends from the end of the arm to define with the planar surface a U-shaped recess for gripping a top coil of a coil spring. The four arms define an X-shaped connecting device and further define an X-shaped opening extending through the connecting device which is approximately one-half the size of the X-shaped connecting device. Alternatively, the four arms define a circular opening extending through the connecting device.

14 Claims, 10 Drawing Sheets

DEVICE FOR CONNECTING SPRINGS TO FORM A SUPPORT SURFACE THEREWITH

FIELD OF THE PRESENT INVENTION

The present invention relates to devices for connecting together springs in a spring assembly commonly found in such items as mattresses and cushions and, in particular, to such devices which provide in conjunction with the connected springs a surface for supporting a load.

BACKGROUND OF THE PRESENT INVENTION

Conventional devices exist for connecting springs together in spring assemblies used in mattresses and cushions. Furthermore, such devices are further used to provide, in conjunction with the connected springs, a more uniform load supporting surface than that formed by the springs alone, the connecting devices serving to support loads applied in-between the springs of a spring assembly where gaps in the load support would otherwise occur.

For example, McMains, U.S. Pat. No. 160,274, discloses such a connecting device formed from a shaped wire. Specifically, the wire is shaped to form four arms with the end of each arm including a C-shaped portion for grasping a coil of a spring. Furthermore, parallel wire segments form each arm and the overall shape of the connecting device is a right angle cross having arms of equal length. The device is used for connecting and binding together of a group of four springs at their base and at their top in a mattress with the ends of the wire arms being bent around the top or bottom coil of the springs. McMains teaches that the connecting devices provide equal and even adjustment of the surface of a mattress when a load is applied by filling the dead space otherwise occurring between the four springs. However, McMains does not disclose any means for varying the support characteristics provided by each connecting device, the support characteristics of each connecting device depending upon the rigidity of the shaped wire forming the connecting device and the length between the connected springs which the connecting piece spans, i.e., the length of each arm.

Warner, U.S. Pat. No. 453,850, discloses another connecting device formed from two flat rectangular pieces that are crossed obliquely and secured together at their intersection to form a right angle cross having arms of equal length. As in McMains, the ends of each arm are bent around a top coil of a connected coil spring, and the connecting device serves the same function as the connecting device in McMains. Unlike in McMains, each arm appears to be solid and appears to have a uniform thickness. Nevertheless, Warner fails to address any means for varying the support characteristics of the connecting device for tailoring the overall support characteristics of the spring assembly, the support characteristics of each connecting device depending upon the rigidity of the material from which the connecting device is formed and the length size of the connecting device, i.e., size of the rectangular pieces forming the connecting device.

Yet another connecting device is disclosed in FIG. 5 of Cleaveland, U.S. Pat. No. 392,009. Called a "spider," the connecting device consists of a metallic plate having four arms each connects to and extends radially outwardly from an annular ring defining a circular opening through the center of the spider. Each arm is solid and of uniform thickness, and the end of each arm is hook shaped for embracing an upper coil of one of four connected coil springs. Cleaveland discloses that each spider is preferably produced in solid form from malleable castings or from plate material cut and pressed to the specified form. Like in McMains and Warner, no means is disclosed or suggested by Cleaveland for varying the support characteristics of the spider for tailoring the overall support characteristics of the spring assembly, the support characteristics of each arm again depending upon the rigidity of the material forming the spider and the size of the spider including the length of the arms and the radius of the annular ring.

Vincent, U.S. Pat. No. 1,273,428, discloses a flat sheet-metal plate with arms for attachment to a top coil of a coil spring itself and, unlike the connecting devices in McMains and Vincent, not for connecting together a plurality of coil springs. Specifically, the plate in Vincent is secured to a single coil of a coil spring and small helical connecting springs are used for connecting an arm of one plate to an arm of another plate secured to the top of another coil spring. In one embodiment, each connecting spring is attached to a coil through an aperture in an attached plate. In another embodiment, each connecting spring extends over an arm prior to its attachment to a coil whereby the connecting spring is retained by the arm's attachment to the coil; the apertures in the arms in this embodiment are therefore omitted. Each plate serves to equalize the loads applied to the surface of the mattress across the top of each coil spring. The arms of the plate being attached to the top coil of a single coil spring also serve to hold the coil spring in proper position and alignment. As is apparent, the device in Vincent does not extend between the spaces between the coil springs and only indirectly supports a load applied in such spaces to the extent that connecting springs disposed there are connected to and supported by the plates. Furthermore, Vincent fails to disclose or suggest a means for varying the support characteristics of the spider for tailoring the overall support characteristics of the spring assembly.

The connecting device of the present invention represents an improvement over the connecting devices of the prior art discussed above because, among other features, the connecting device includes a stiffening portion which can be varied during the manufacturing thereof to vary the load support characteristics of the connecting device and, consequently, each connecting device can be customized to tailor the load support characteristics of a spring assembly in which connecting devices are used. Furthermore, as a consequence of the provision of a stiffening portion, the support characteristics of the connecting device can be varied with varying the materials from which the connecting device is constructed and without varying the length of the arms or the overall dimensions of the connecting device.

BRIEF SUMMARY OF THE PRESENT INVENTION

Briefly summarized, the connecting device of the present invention for coupling together a group of springs in a spring arrangement includes a plurality of arm portions each extending in an outward radial direction from a center of the connecting device. Each arm portion includes a finger portion for gripping a spring, the length of each arm portion being defined by two substantially straight sides of the arm portion extending in spaced relation to one another. At least one of the arm portions includes a stiffening portion extending in a widthwise direction between the straight sides of the one arm portion and extending along the length of the one arm portion.

In a feature of the present invention, the straight sides of each arm portion have identical height dimensions in a direction orthogonal to the length and to the widthwise direction of the arm portion, and the stiffening portion has a lesser height than the height of the straight sides.

In another feature of the present invention, each stiffening portion extends the length of the arm portion.

A preferred spring arrangement in accordance with the present invention includes four coil springs each having a top coil connected to two other top coils of the coil springs by a single connecting device to define a support surface.

In the preferred connecting devices: four arm portions each extend in an outward radial direction from a center of the connecting device; the length of each arm portion is defined by two substantially straight sides of the arm portion extending in spaced relation to one another; each arm portion includes a stiffening portion extending in a widthwise direction between the straight sides of the arm portion and extending along the length of the arm portion; the straight sides of each arm portion have identical height dimensions in a direction orthogonal to the length and to the widthwise direction of the arm portion; each arm portion includes an end portion connecting the sides of each arm portion together; the end portion includes a curved surface extending in curved relation within a plane defined by the lengthwise and widthwise directions of the arm portion and extending parallel to the heightwise direction; the sides and the stiffening porting of each arm portion define a planar surface of the arm portion and a finger portion extends from the end portion of the arm portion to define with the planar surface a U-shaped recess for gripping therein one of the top coils of the four coil springs; and each arm portion is identical to the other arm portions of the connecting device.

In a particular preferred connecting device, the stiffening portion preferably has a lesser height than the height of the straight sides and each stiffening portion preferably extends from the end portion towards the center of the connecting device only partially along the length of its respective arm portion. Furthermore, the four arm portions define an X-shaped connecting device and further define an X-shaped opening extending through the connecting device which is approximately one-half the size of said X-shaped connecting device. Alternatively, the four arm portions define a circular opening extending through the connecting device rather than an X-shaped opening.

DETAILED DESCRIPTION OF PREFERRED EMBODIMENTS OF THE PRESENT INVENTION

Figure 1:
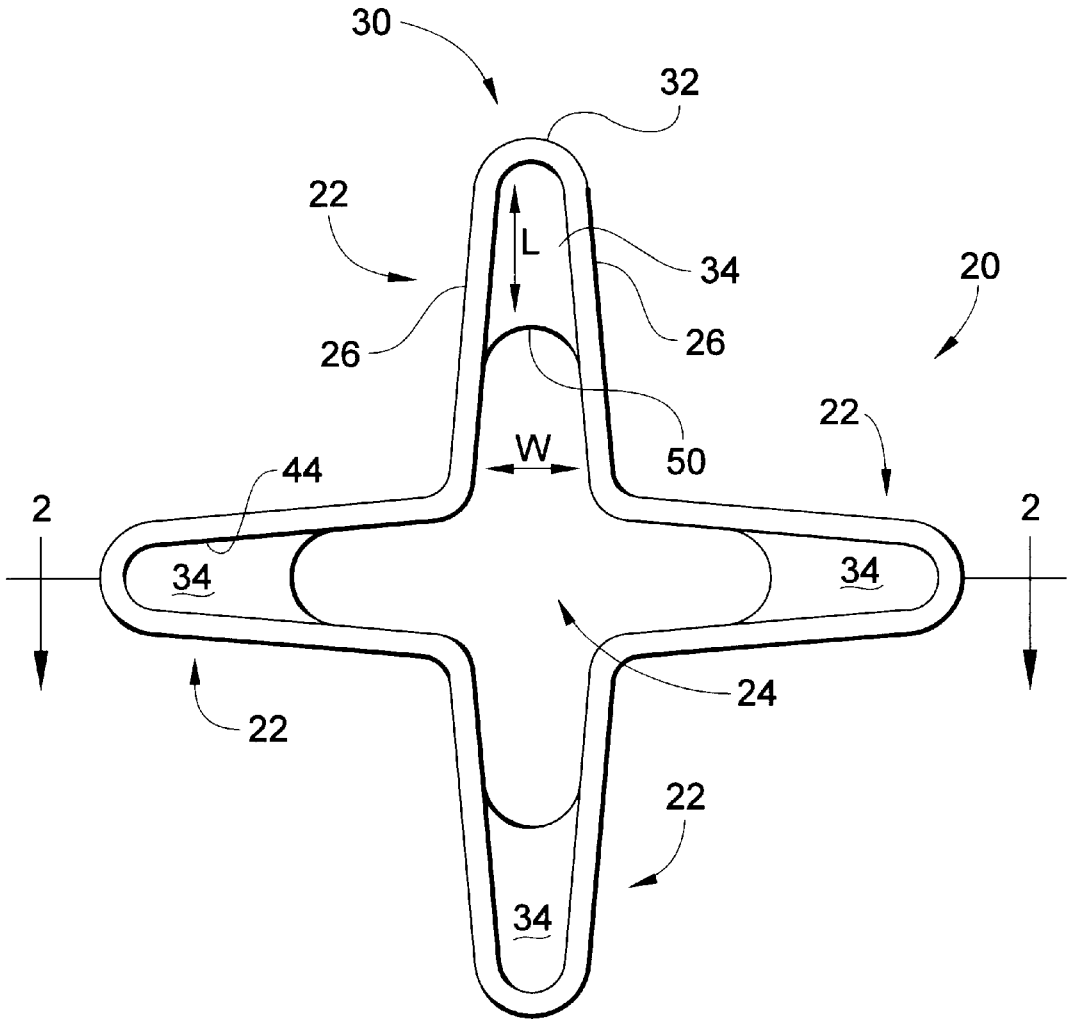
FIG. 1 is a top plan view of a connecting device of the present invention.

Referring now to the Figures, wherein like structures are referred to with like reference numerals, three different preferred connecting devices 20 of the present invention are shown in FIGS. 1–4, 5–8, and 9–12, respectively.

Figure 2:
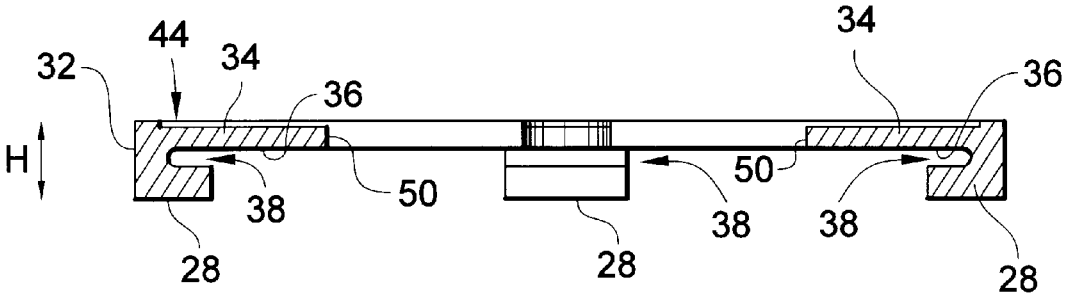
FIG. 2 is a cross-sectional view of the connecting device of FIG. 1 taken along the line 2—2.
Figure 3:
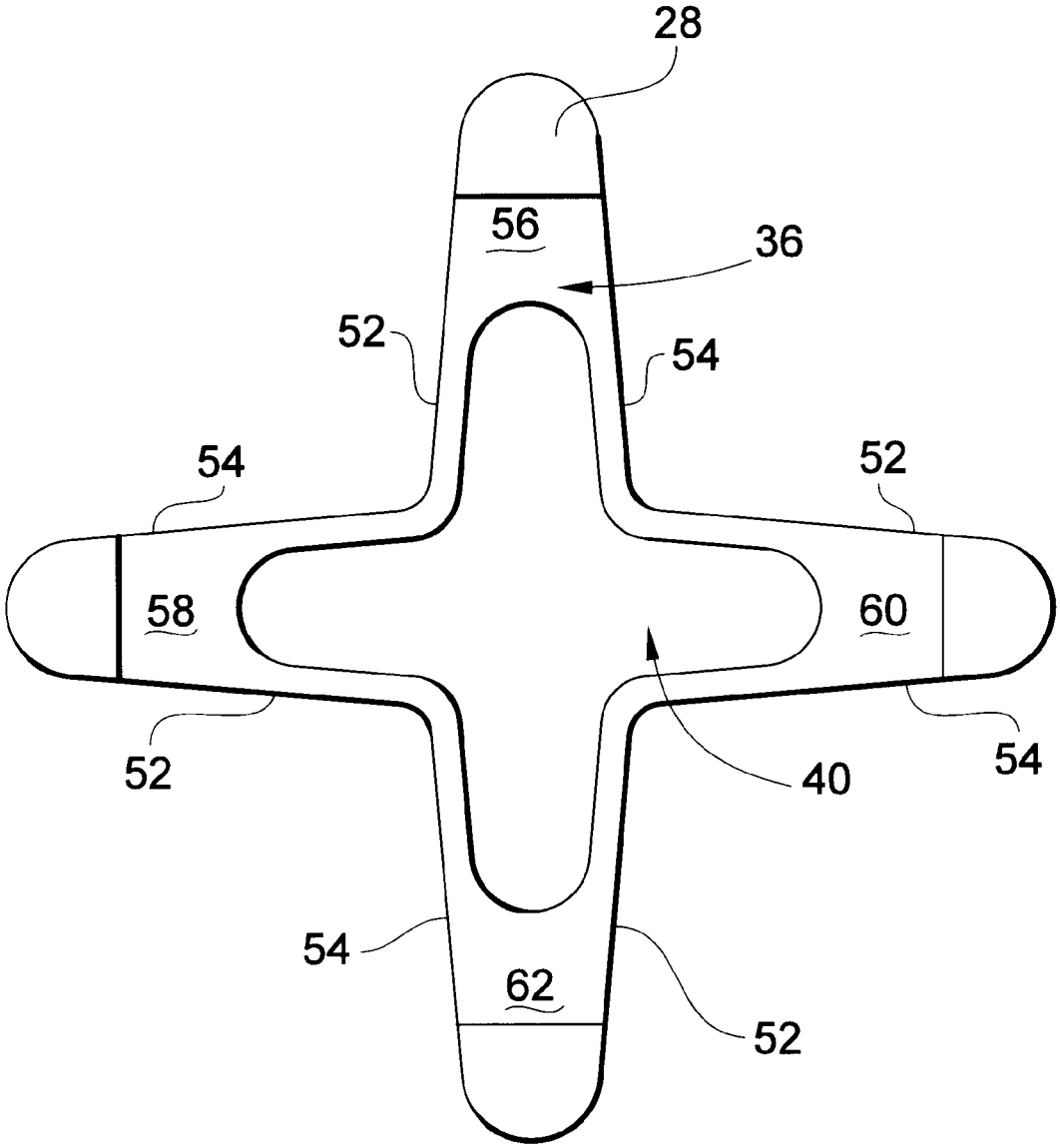
FIG. 3 is a bottom plan view of the connecting device of FIG. 1.
Figure 4:
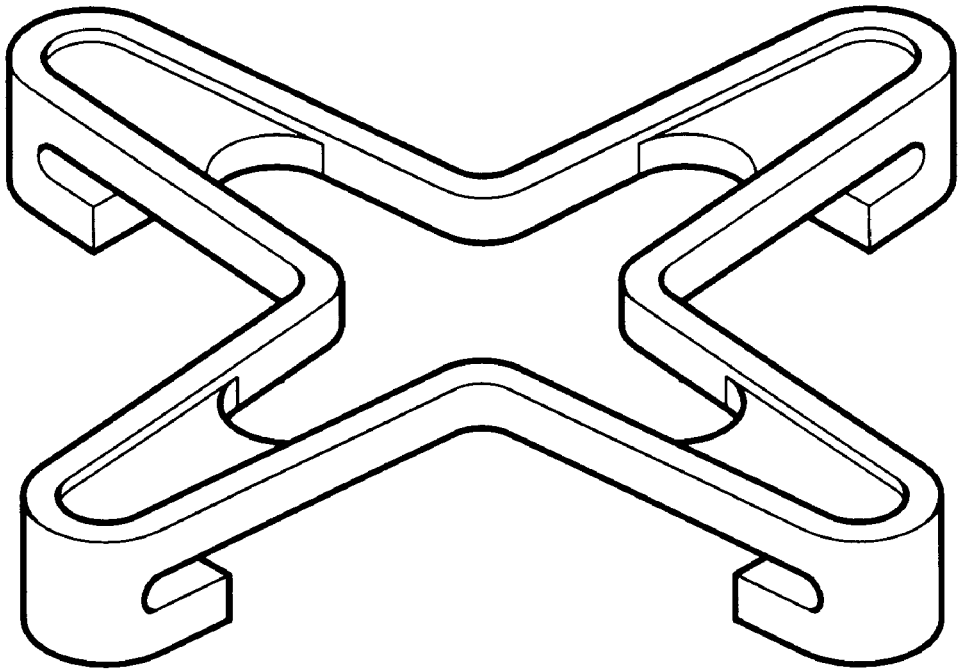
FIG. 4 is a perspective view of the connecting device of FIG. 1.
Figure 5:
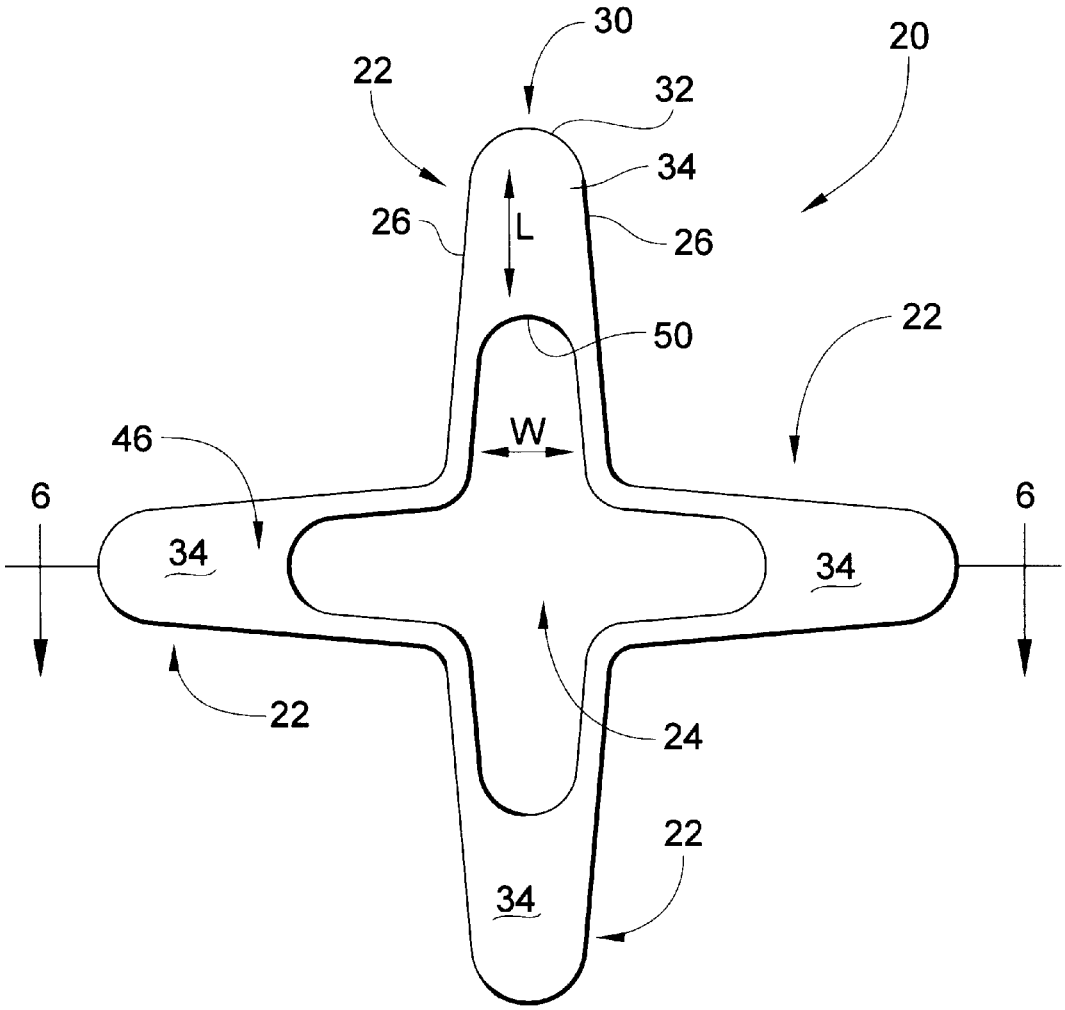
FIG. 5 is a top plan view of another connecting device of the present invention.
Figure 6:
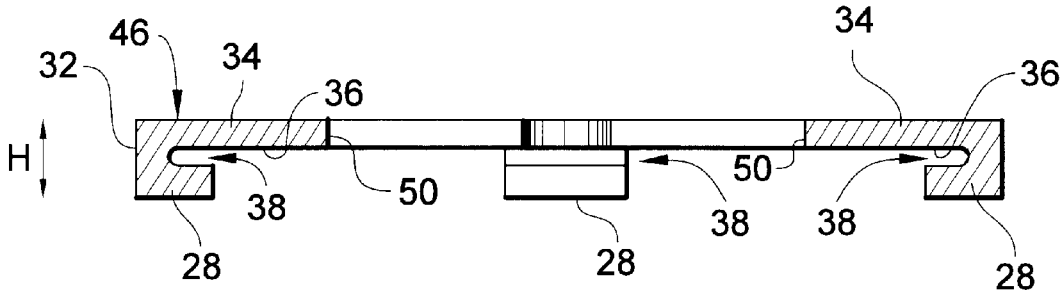
FIG. 6 is a cross-sectional view of the connecting device of FIG. 5 taken along the line 6—6.
Figure 7:
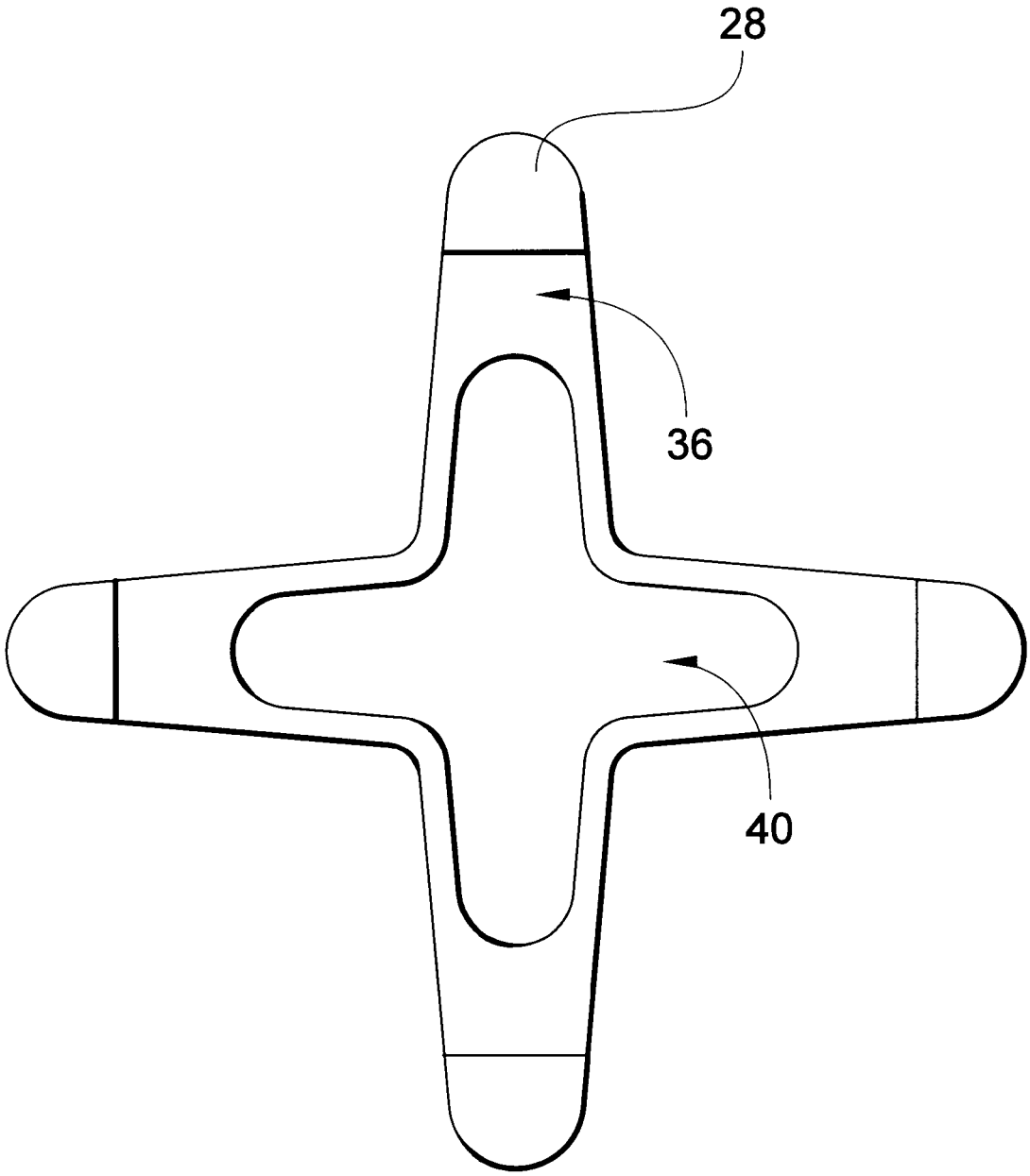
FIG. 7 is a bottom plan view of the connecting device of FIG. 5.
Figure 8:
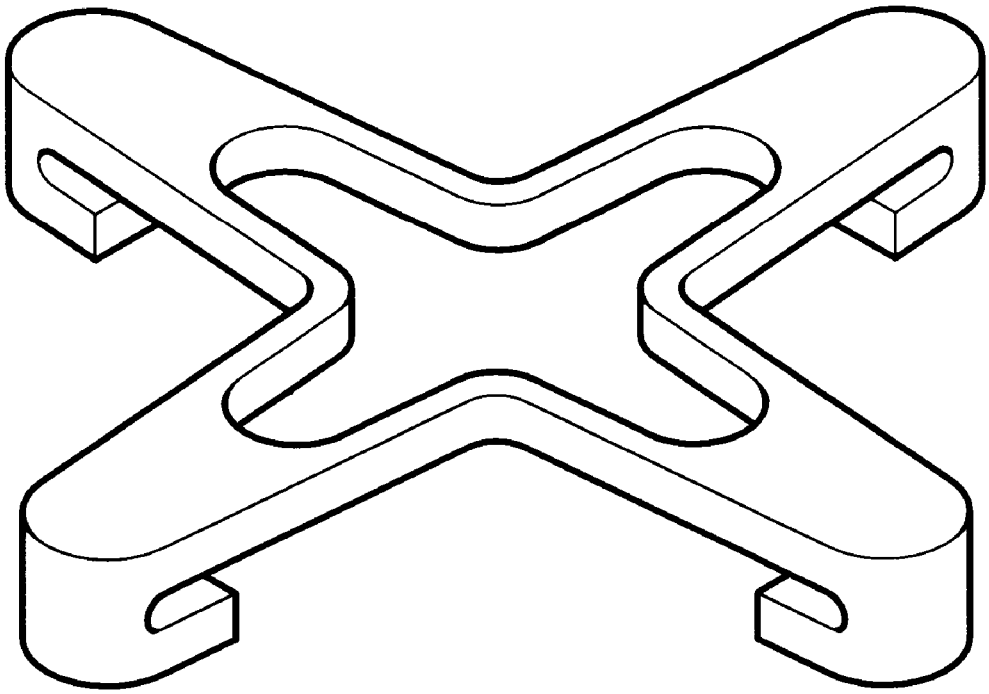
FIG. 8 is a perspective view of the connecting device of FIG. 5.
Figure 9:
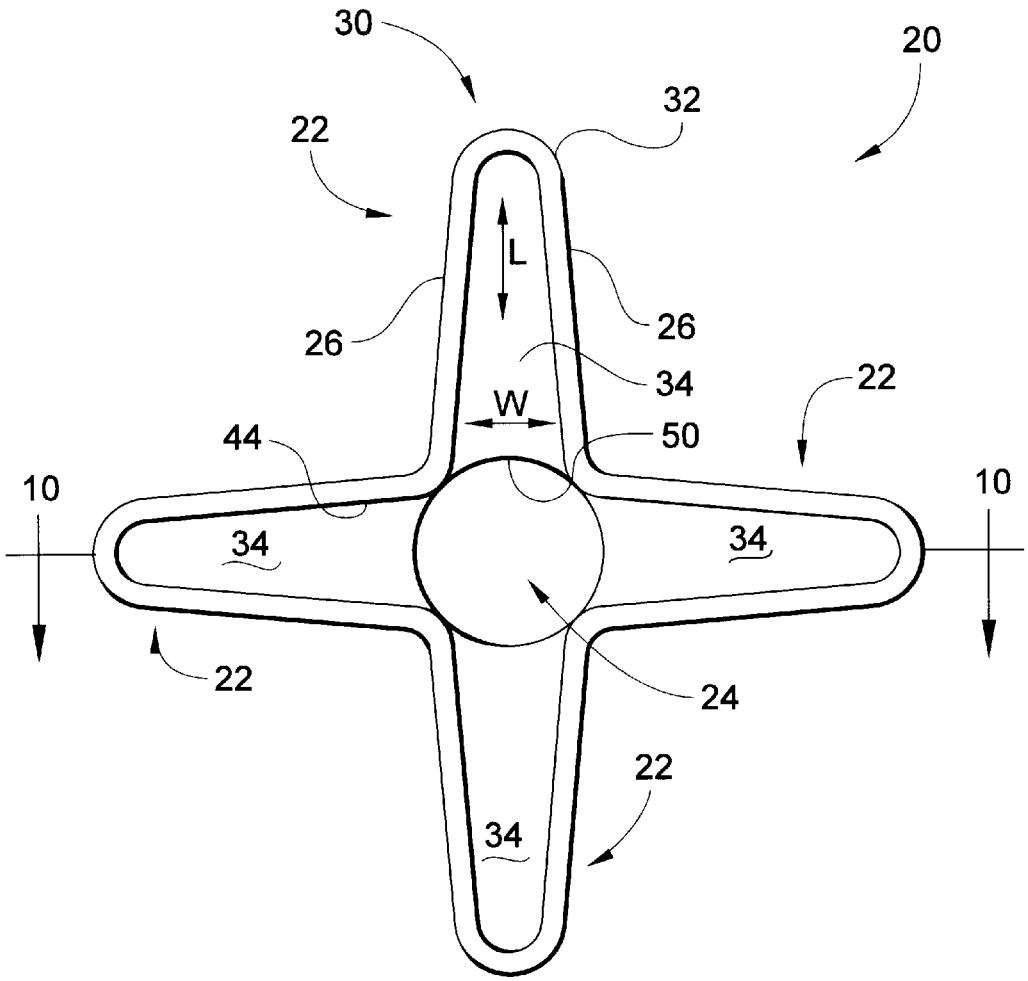
FIG. 9 is a top plan view of yet another connecting device of the present invention.
Figure 10:
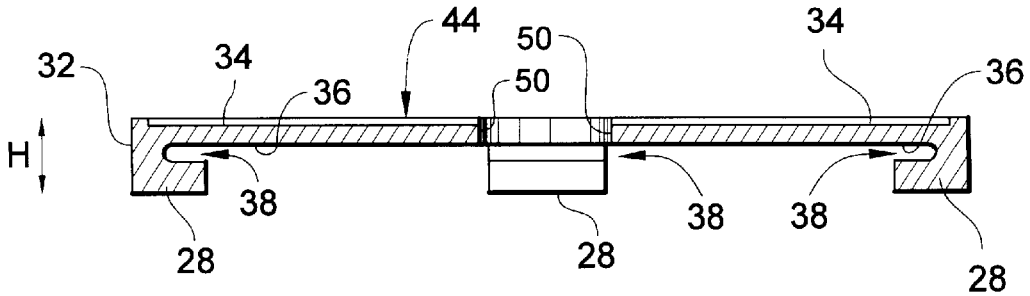
FIG. 10 is a cross-sectional view of the connecting device of FIG. 9 taken along the line 10—10.
Figure 11:
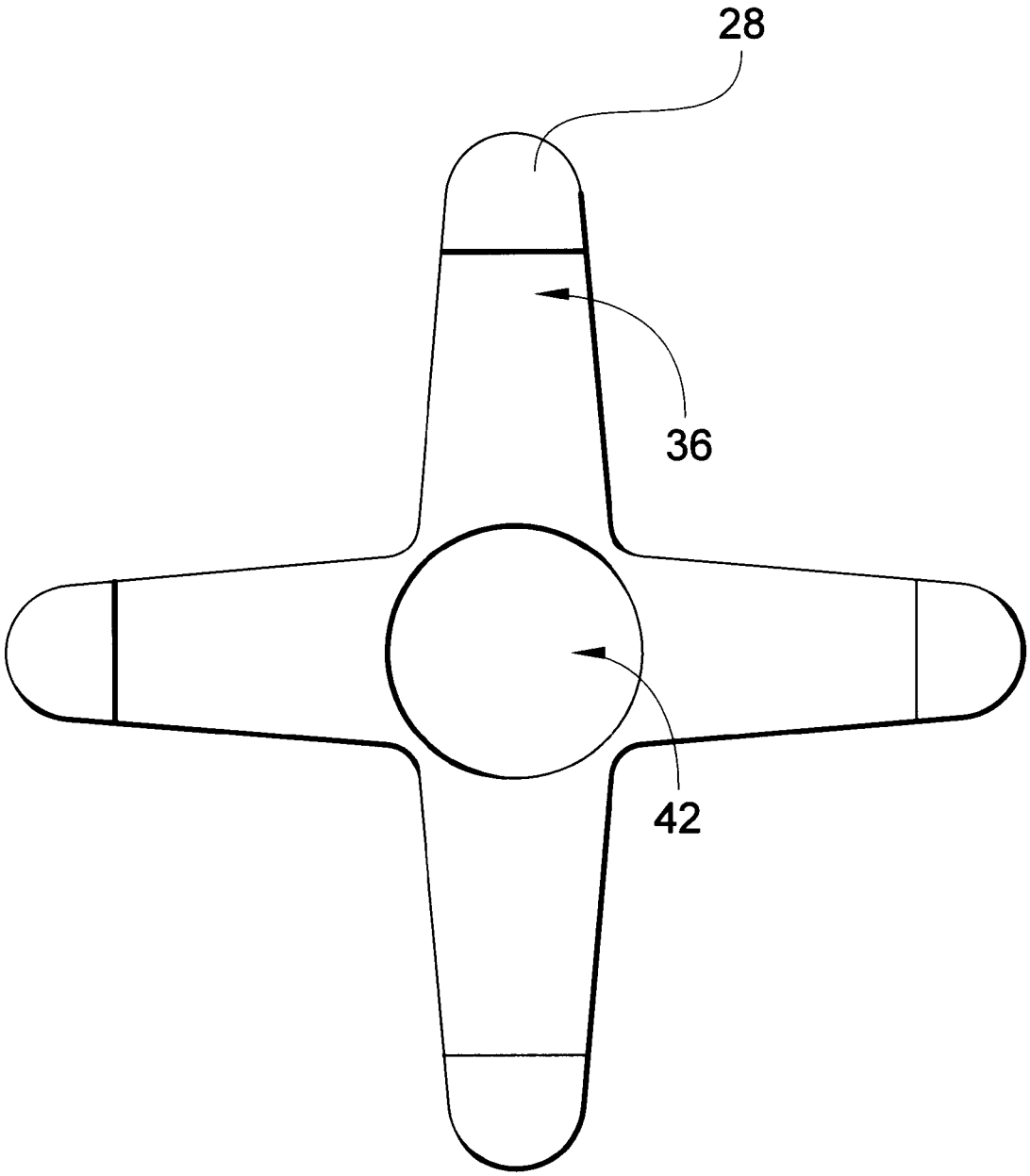
FIG. 11 is a bottom plan view of the connecting device of FIG. 9.
Figure 12:
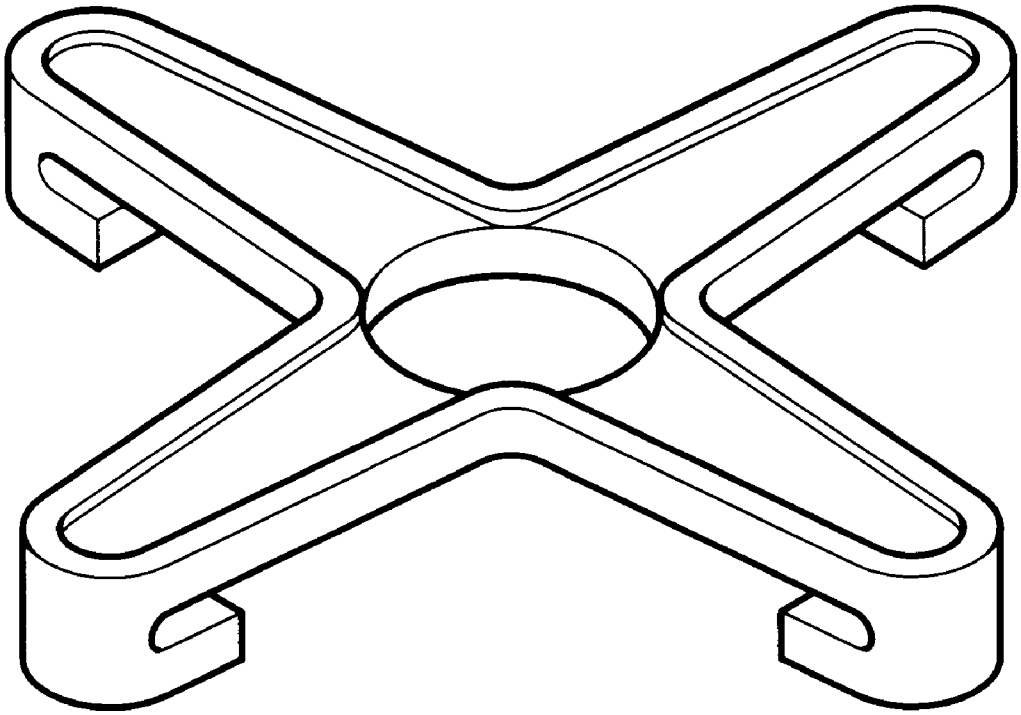
FIG. 12 is a perspective view of the connecting device of FIG. 9.

Each preferred connecting device 20 includes four arm portions 22 each extending in an outwardly radial direction from a center 24 of the connecting device 20. Each arm portion 22 includes two substantially straight sides 26 extending away from the center 24 of the connecting device 20 in spaced relation to one another and defining the length of the arm portion 22, and each arm portion 22 includes a finger portion 28 disposed at an end portion 30 thereof for gripping a coil of a coil spring. The sides 26 of each arm portion 22 have identical height dimensions in a direction H that is orthogonal to the lengthwise direction L and a widthwise direction W of the arm portion 22. The end portion 30 of the arm portion 22 connects the sides 26 to one another and includes a curved surface 32 extending in curved fashion within a plane defined by the lengthwise direction L and widthwise direction W of the arm portion 22 (as shown in FIGS. 1, 5, and 9) and extending parallel to the heightwise direction H of the arm portion 22 (as shown in FIGS. 2, 6, and 10).

In accordance with the present invention, each arm portion 22 includes a stiffening portion 34 which extends in the widthwise direction W orthogonal to the length of the arm portion 22 between the sides 26 of the arm portion 22 to connect the two sides 26 together along their length. Each stiffening portion 34 preferably extends from the end portion 30 of the arm portion 22 towards the center 24 of the connecting device 20 and terminates at an edge 50 of the stiffening portion 34 extending between the sides 26. The stiffening portion 34 serves to stiffen the arm portion 22 making the arm portion 22 more rigid and less flexible. Each edge 50 of the stiffening portion 34 also defines with the arm portions 22 of the connecting device 20 an opening extending through the connecting device 20. Additionally, the sides 26 of each arm portion 22 in conjunction with the stiffening portion 34 form a planar surface 36 on the bottom of the connecting device 20, and the finger portion 28 extends from and defines with this planar surface 36 at the end portion 30 a U-shaped recess 38 for gripping a coil of a coil spring therein.

In a feature of the present invention as shown in the embodiments of FIGS. 1–4 and in FIGS. 5–8, the stiffening portion 34 of each arm portion 22 extends only along a partial length of the arm portion 22 and does not extend the full length of the arm portion 22. In these two embodiments, moreover, the arm portions 22 together with the edges 50 of the stiffening portions 34, define an X-shaped opening 40 extending through the connecting device 20 which is approximately one-half the overall size of the X-shaped connecting device 20 defined by the sides 26 and end portions 30 of the connecting device 20.

Unlike these two embodiments, the embodiment of FIGS. 9–12 includes a stiffening portion 34 which extends the length of the arm portion 22. Furthermore, the edges 50 of the four arm portions 22 form a circular opening 42 in the center of the connecting device 20 as opposed to the X-shaped opening 40 found in the other two embodiments. It is furthermore contemplated within the scope of the present invention that the edges 50 be V-shaped to thereby form a square opening (not shown) extending through the connecting device 20. Likewise, the edges 50 could be any other shape in order to yield a desired configuration for the opening extending through the connecting device 20.

In yet a further feature of the present invention as shown in the embodiments of FIGS. 1–4 and in FIGS. 9–12, each stiffening portion 34 has a height that is less than that of the sides 26 of each arm portion 22, with the sides 26 extending above the stiffening portion 34 on the top side of the connecting device 20 as shown at 44 in FIGS. 1 and 9. The connecting device 20 of FIGS. 5–8 differs from the two embodiments of FIGS. 1–4 and FIGS. 9–12 in that the stiffening portion 34 and sides 26 of each arm portion 22 form not only the planar surface 36 on the bottom of the connecting device 20 but also another planar surface 46 on the top of the connecting device 20 on each arm portion 22.

The preferred connecting device 20 is integrally formed from plastic and, particularly, from either delrin or nylon. Furthermore, with particular regard to FIGS. 3 al an illustrative example, the construction of the preferred connecting device 20 includes a first side 52 of a first arm portion 56 that is integrally joined to a second side 54 of a second said arm portion 58 and a second side 54 of the first arm portion 56 that is integrally joined to a first side 52 of a third arm portion 60. Likewise, a first side 52 of a fourth arm portion 62 is integrally joined to a second side 54 of the third arm portion 60 and a second side 54 of the fourth arm 62 portion is integrally joined to a first side 52 of the second arm portion 58.

Figure 13:
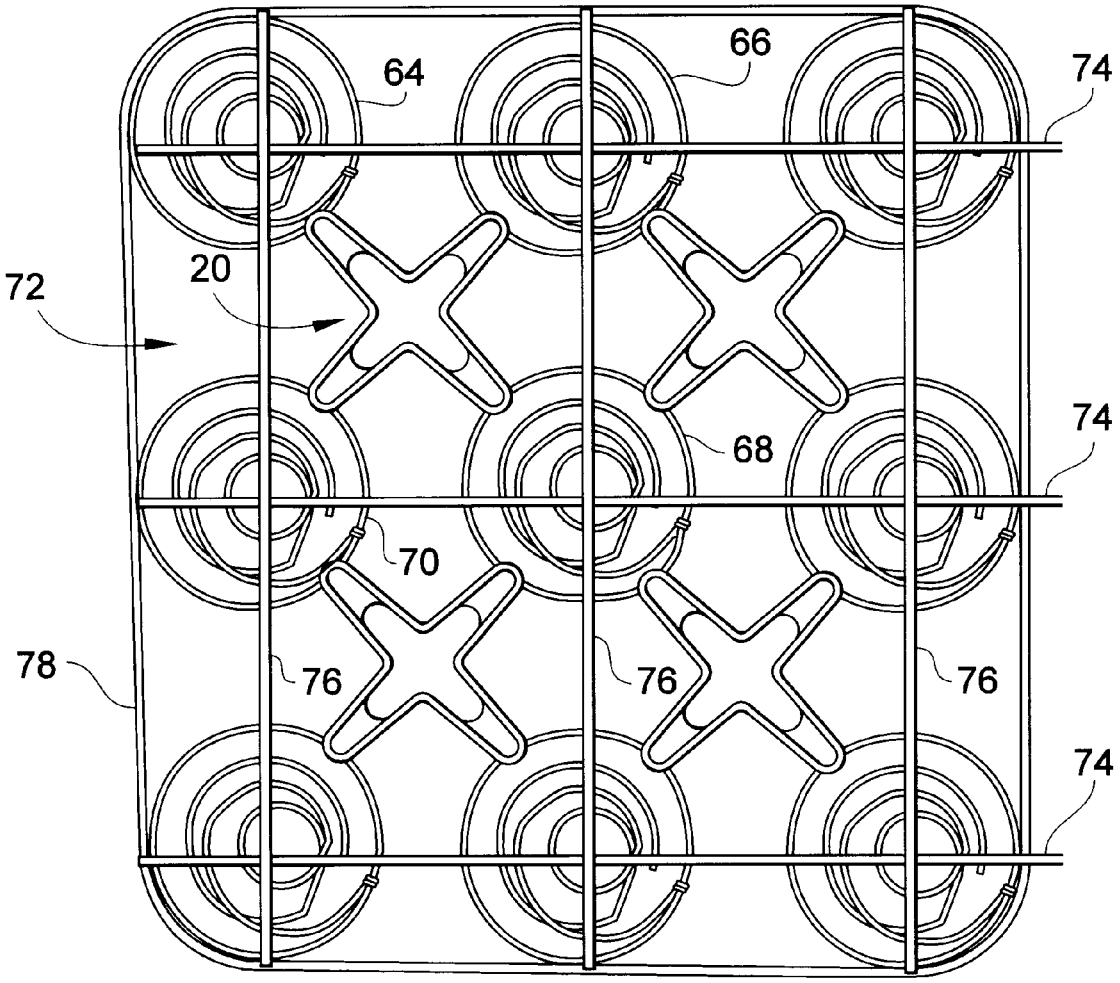
FIG. 13 is a top plan view of a spring assembly for a box spring cushion including connecting devices of FIG. 1.

A spring assembly composed of four overlapping spring arrangements in a box spring assembly is shown in FIG. 13 in which preferred embodiments of the connecting device 20 of FIGS. 1–4 are used as an illustrative example, it being understood that either one of the other two preferred embodiments of FIGS. 5–8 and 9–12, respectively, could be used in like manner.

In FIG. 13, a connecting device 20 links four coils springs 64,66,68,70 in a spring arrangement 72. The coil springs 64,66,68,70 are attached to the grid wires 74,76 and border wire 78 in conventional manner, and the connecting device 20 is disposed within a rectangular opening defined by the grid wires 74,76 and border wire 78 of the box spring assembly in order to support a load applied between these rectangular openings in the spaces between these coil springs. In particular, the connecting device 20 is attached within this space by extending a top coil of each spring 64,66,68,70 within the U-shaped recess 38 of each arm portion 22 of the connecting device 20.

It will therefore be readily understood by those persons skilled in the art that the connecting device of the present invention have support characteristics that can be varied by varying the thickness (height dimension) of the stiffening portion as well as by varying the length the stiffening portion extends along the arm portion. To increase the rigidity of a connecting device, the stiffening portion can be increased in height and/or lengthened along the arm portion during the manufacturing process, and to decrease the rigidity of a connecting device, the stiffening portion can be decreased in height and/or shortened along the arm portion during the manufacturing process. Moreover, as will now be apparent to one having ordinary skill in the art, the support characteristic can be varied without changing the material from which the connecting device is constructed and without changing the overall size of the connecting device.

It will further be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A connecting device for coupling together a group of springs, comprising:

a plurality of arm portions each extending in an outward radial direction from a center of the connecting device, each said arm portion including a finger portion for gripping a spring, the length of each arm portion being defined by two substantially straight sides of said arm portion extending in spaced relation to one another;

at least one of said arm portions including a stiffening portion extending in a widthwise direction between said straight sides of said one arm portion and extending only partially along the length of said one arm portion.

2. A connecting device according to claim 1, wherein said straight sides of said one arm portion have identical height dimensions in a direction orthogonal to said length and to said widthwise direction of said one arm portion, and wherein and said stiffening portion has a lesser height than the height of said straight sides.

3. A connecting device for coupling together a group of springs, comprising:

a plurality of arm portions each extending in an outward radial direction from a center of the connecting device, each said arm portion including a finger portion for gripping a spring, the length of each arm portion being defined by two substantially straight sides of said arm portion extending in spaced relation to one another;

at least one of said arm portions including a stiffening portion extending in a widthwise direction between said straight sides of said one arm portion and extending along the length of said one arm portion, said straight sides of said one arm portion having identical height dimensions in a direction orthogonal to said length and to said widthwise direction of said one arm portion, said stiffening portion having a lesser height than the height of said straight sides.

4. A connecting device according to claim 3, wherein each said stiffening portion of said one arm portion extends only partially along the length of said one arm portion.

5. A spring arrangement including four coil springs each having a top coil connected to two other top coils of said coil springs by a single connecting device to define a support surface, said connecting device including four arm portions each extending in an outward radial direction from a center of said connecting device, each said arm portion including a finger portion for gripping said top coil of a said coil spring, the length of each arm portion being defined by two substantially straight sides of said arm portion extending in spaced relation to one another; each said arm portion including a stiffening portion extending in a widthwise direction between said straight sides of said one arm portion and extending along the length of said one arm portion, said straight sides of said one arm portion having identical height dimensions in a direction orthogonal to said length and to said widthwise direction of said arm portion, said stiffening portion having a lesser height than the height of said straight sides.

6. A spring arrangement according to claim 5, wherein each said stiffening portion extends only partially along the length of each respective said arm portion.

7. A spring arrangement according to claim 5, wherein a first side of a first said arm portion connects to a second side of a second said arm portion and a second side of said first arm portion connects to a first side of a third said arm portion; and wherein a first side of a fourth said arm portion connects to a second side of said third arm portion and a second side of said fourth arm portion connects to a first side of said second arm portion.

8. A spring arrangement according to claim 5, wherein said four arm portions define an X-shaped opening extending through said connecting device.

9. A spring arrangement according to claim 5, wherein said four arm portions define an X-shaped connecting device and further define an X-shaped opening extending through said connecting device which is approximately one-half the size of said X-shaped connecting device.

10. A spring arrangement according to claim 5, wherein each said arm portion includes an end portion connecting said sides of each said arm portion together, said end portion including a curved surface extending in curved relation within a plane defined by the lengthwise and widthwise directions of said arm portion and extending parallel to the heightwise direction.

11. A spring arrangement according to claim 5, wherein said sides and said stiffening porting of a said arm portion define a planar surface of said arm portion and said finger portion extends from said curved end portion of said arm portion to define with said planar surface a U-shaped recess for gripping therein a said top coil of said four coil springs.

12. A spring arrangement according to claim 5, wherein said stiffening portion extends from said end portion towards the center of said connecting device.

13. A spring arrangement according to claim 5, wherein each said arm portion is identical to said other arm portions of said connecting device.

14. A spring arrangement according to claim 5, wherein said four arm portions define a circular opening extending through said connecting device.

* * * * *